United States Patent [19]

Nevin et al.

[11] 4,240,783

[45] Dec. 23, 1980

[54] COMBINED DISPLAY CONTAINER, CIGARETTE LIGHTER, CANDLE HOLDER

[76] Inventors: William Nevin, c/o George Spector, 3615 Woolworth Bldg., 233 Broadway; George Spector, 3615 Woolworth Bldg., 233 Broadway, both of New York, N.Y. 10007

[21] Appl. No.: 822,387

[22] Filed: Aug. 5, 1977

[51] Int. Cl.[3] ..... F23D 15/04

[52] U.S. Cl. ..... 431/253; 431/126

[58] Field of Search ..... 431/253, 126, 288, 289, 431/291, 344; 40/10

[56] References Cited

U.S. PATENT DOCUMENTS

| | | | |
|---|---|---|---|
| 2,274,823 | 3/1942 | Candy | 431/291 X |
| 2,749,733 | 6/1956 | Smith et al. | 431/344 X |
| 3,077,981 | 2/1963 | Gaspard | 431/126 |
| 3,342,363 | 9/1967 | Thrush | 431/253 X |
| 4,073,612 | 2/1978 | Hitta | 431/126 |

*Primary Examiner*—Edward G. Favors

[57] ABSTRACT

An article of manufacture which is a combination container, cigarette lighter, candle holder, and the like; the container being suitable to hold liquids, powders, cigarettes or other substances, and the article being made in either of various different models so to suit specific various applications, and wherein the container are all decorated by removable decorative inserts mounted within the container.

4 Claims, 30 Drawing Figures

80
83
82
89
87
88
89
89a
86
81
15
84
85
90
83
95
94
92
93
91

83
100
95
94
103
102
101 a
119
b
119A
110
c
117
115
114
111
118
112
116
e
114
111
115
d
113
112

125
124
126
122a
122
121
123
120
15
122
124

12
137
130
136
138
131
15
122
133
134
132

135
25A
133
132
133

160
LAR
163

12
166
165
164
114a
114
162
161

12
191
192
15
190
193, 194

200
202
203
12
15
204
205
201
193
194

194
193
114
115
12

223
227
228
226
221
224
225

220
15

233
230
234
232
15
231
235
231a 250
26

12
251
252
253
254
255
256
257
258
CIGARETTE
270

280
281
282
283
12
15
284
286
290

289
288
287
30

285

COMBINED DISPLAY CONTAINER, CIGARETTE LIGHTER, CANDLE HOLDER

This invention relates generally to novelty articles. More specifically it relates to articles that combine a number of different uses.

A principal object of the present invention is to provide a combination device which includes a container that is combined with either a cigarette lighter and/or a candle holder or the like.

Another object is to provide a combination device which is suitable as a display either in a retail store or else at home for decorative purposes.

Still another object is to provide a combined display container, cigarette lighter, candle holder, and the like which can be manufactured in a large variety of different models so to be particularly ideal for numerous kinds of uses.

Other objects are to provide a combined display container, cigarette lighter, candle holder and the like which is simple in design, inexpensive to manufacture, rugged in construction, easy to use and efficient in operation.

These and other objects will be readily evident upon a study of the following specifications and the accompanying drawings wherein.

All the outer covers of the containers seen in all the Figures are transparent with some appropriate decorative insert therein.

Figure 1:
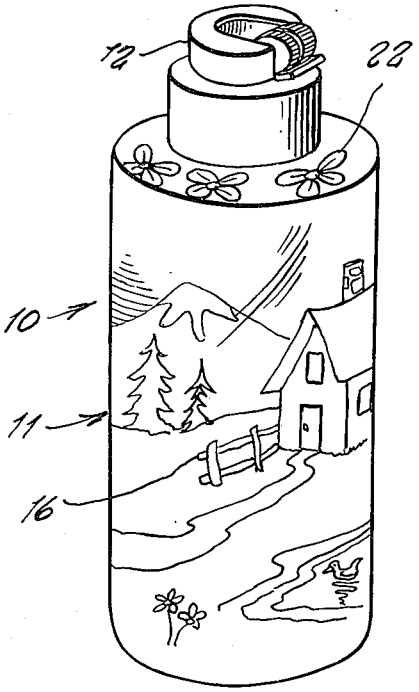
FIG. 1 is a perspective view of one design of the Invention shown incorporating a cigarette lighter.
Figure 2:
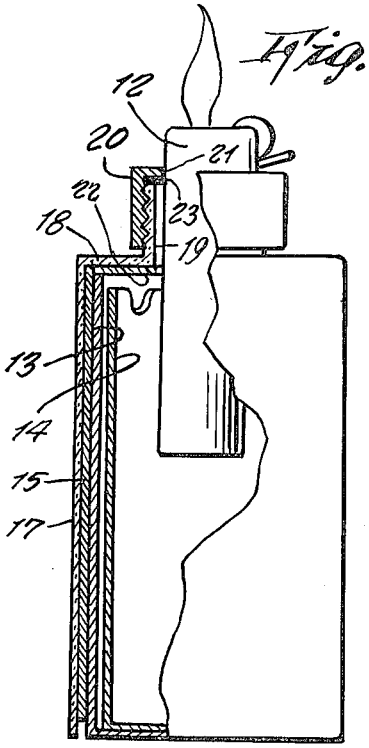
FIG. 2 is a side view thereof shown partly in cross section
Figure 3:
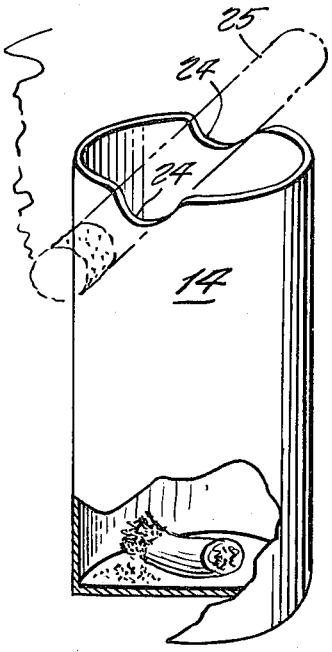
FIG. 3 shows the innermost bottle used as ashtray and cigarette holder.

Referring now to the drawings in greater detail, and more particularly to FIGS. 1, 2 and 3 thereof at this time, the reference numeral 10 represents a combination article according to the present invention wherein the same comprises a cylindrical container having topless bottle 14 snugly telescoped in topless bottle 13 which is in turn telescoped into bottomless outer vessel 17. A card 15 with a lovely picture 16 is fitted snugly between the outer vessel 17 and the bottle 13. Vessel 17 is transparent whereby the picture 16 is seen therethrough making a very attractive container display. It is to be noted that a decorated disc 22 with a central hole may be fitted in the space between the top of the bottle 13 and 18 to complete the decorated appearance of the assembly.

A top wall 18 with an upward neck 19 threaded on its outer side engages a screw cap 20 having a central opening 21 therethrough in which the cigarette lighter 12 is fractionally held. Circular disc 22 has a central opening for the cigarette lighter. The disc 22 is made of any stiff card or paper. A gasket 23 is provided under the cap. A pair of opposite notches 24 on the upper edge of bottle 14 so that the bottle can serve as an ashtray, and to hold a cigarette 25 in notches 24.

Figure 4:
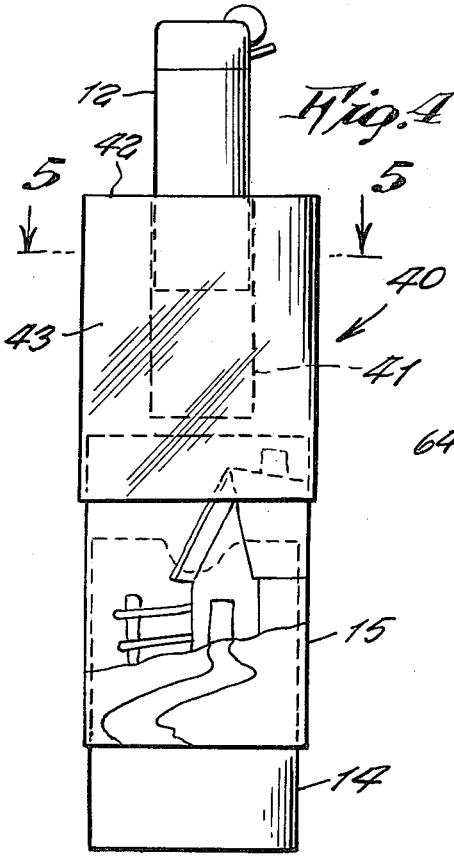
FIG. 4 is a side view of a modified design of the Invention.
Figure 5:
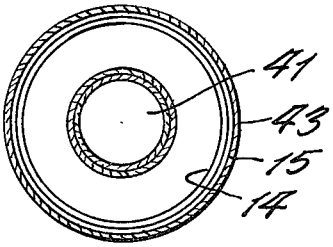
FIG. 5 is a cross section on line 5—5 of FIG. 4.

FIGS. 4 and 5 show a modified design of device 40 having inner bottle 14, picture card 15 and a cigarette lighter 12 in a pocket 41, extending downward from a top wall 42 of an outer transparent plastic cover 43 that encloses the bottle 14 and card.

Figure 6:
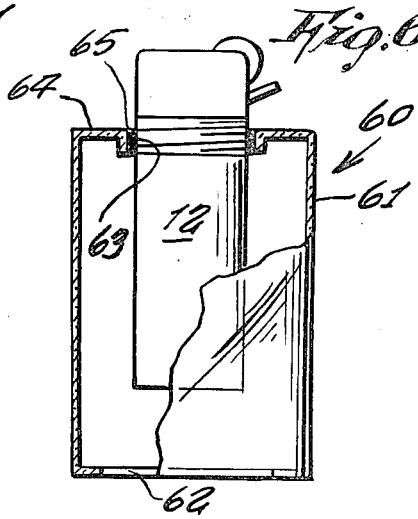
FIG. 6 shows another design

In FIG. 6, another modified design of a device 60 shows a transparent cover 61 having constricted hole 62 at its bottom and an opening 63 in a topwall 64 lined with gasket 65 for frictionally holding the cigarette lighter.

Figure 7:
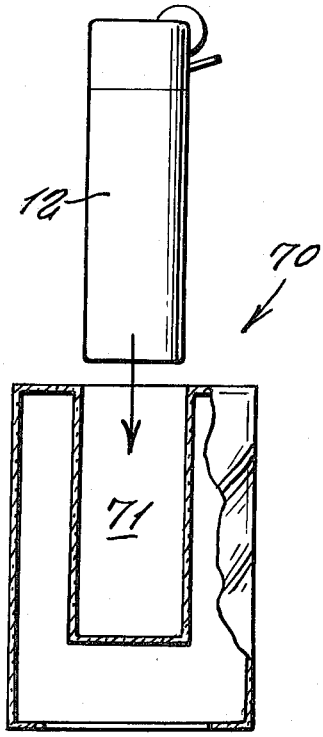
FIG. 7 shows still another design

In FIG. 7 a device 70 is similiar to device 60 except that instead of a top opening in its topwall, it has a pocket 71 extending downward and in which the cigarette lighter fits.

A decorative insert (not shown) may be mounted in the cover of FIGS. 6 and 7.

Figures 8, 9, 10, 11, 12, 13, 14, 15:
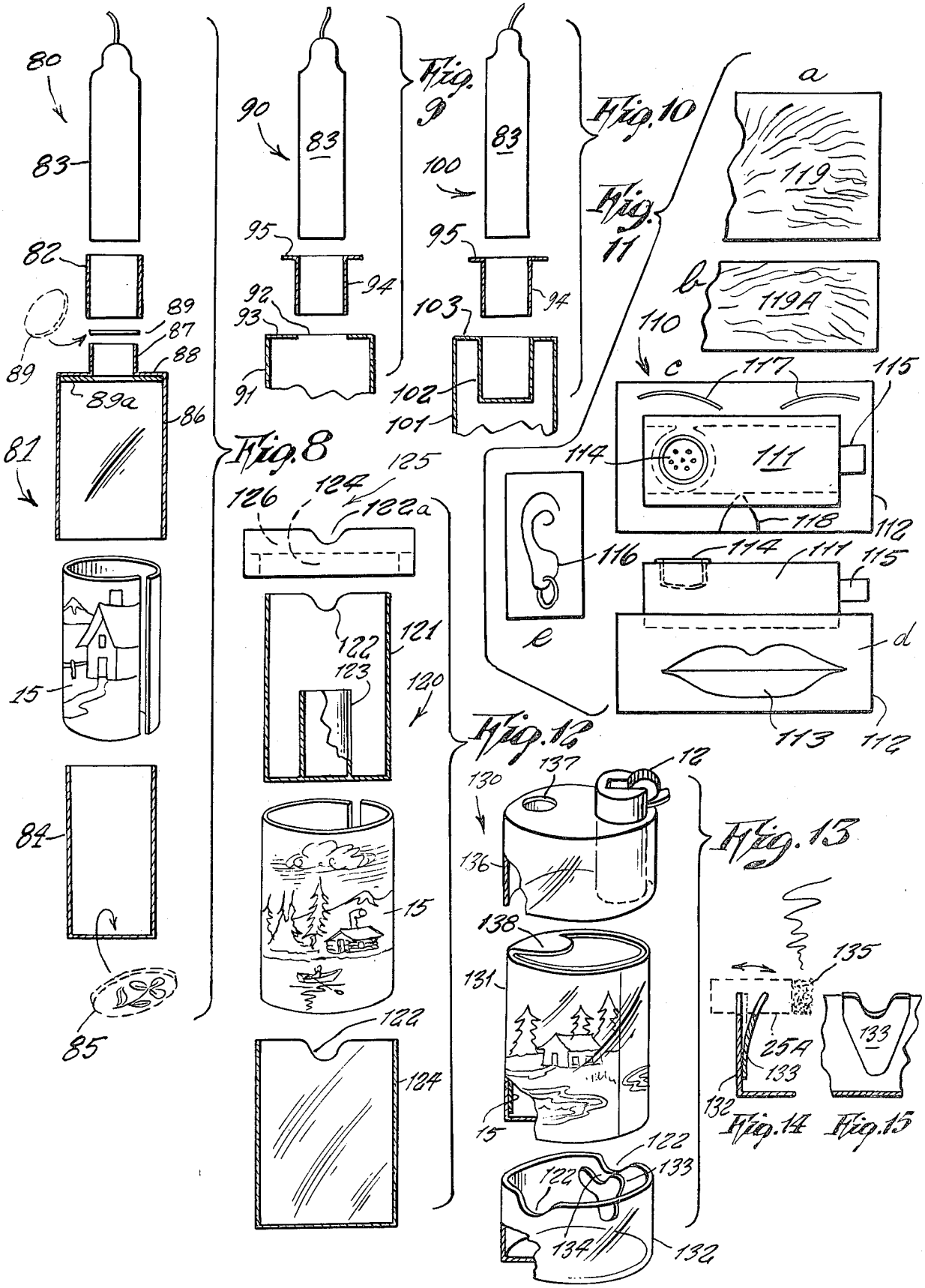
FIG. 8 shows a design of the Invention including a candle stand.
FIGS. 9 and 10 show modified designs thereof.
FIG. 11 shows view a, b, c, d and e.
FIG. 12 shows still another design
FIG. 13 shows a further modified design in which there is included a container to hold cigarettes, a rotatable top having a hole to align with opening in the container so to dispense a cigarette at a time, and which at other times seals the container and a removable ash tray filling in the bottom of the container.
FIGS. 14 and 15 show cross section and a side view of a flexible tongue adjacent a cigarette supporting notch of the ash tray of FIG. 13, so to allow holding a burning end of the cigarette over the center of the ash tray in order to catch ashes therefrom.

In FIG. 8, another modified design 80 is shown comprised of a container 81 and a metal candle holder 82 for holding a candle 83. The container 81 includes a transparent topless vessel 84 having picture disc 85 placed on a bottom thereof. A picture card 15 around the outer side of the vessel is enclosed by a bottomless, transparent cover 86 which has an upward neck 87 from a top wall 88. A rigid metal disc 89 sits on the upper edge of the neck, and it is enclosed by the sleeve-shaped candle holder that slide fits around the neck. Thus a pocket is formed above the disc in which the candle is inserted so to rest on the disc. A disc 89*a* with a central hole is mounted between wall 88 and the card 15 for decorative purposes.

In FIG. 9, a modified device 90 is similiar to device 80 except that a cover 91 has a hole 92 in a topwall 93 thereof to accept a candle holder having a sidewardly outward flange 95 around its upper edge that engages top wall 93.

In FIG. 10 another modified design 100 is depicted similar to device 90 except that cover 101 includes a downward pocket 102 from a topwall 103 so as to receive the holder 94 containing candle 83.

In FIG. 11, a device 110 seen to include a container 111 which is displayed in horizontal position upon a carton 112 which is decorated on its outer side with a picture of a pair of lips 113 so to advertise lotion or other substances in the container depending on the product. Container 111 is preferably transparent and includes a decorative insert.

The container 111 shown includes a metal perforated cup for tabacco 114 is depressed in a hole in the side of the container so that the container may serve as a pipe. A tube 115 in the end of the container serves as a mouthpiece for the pipe.

One end of the container shows a picture of a lady's ear 116. The top supporting the container has a picture of a lady's eyebrows 117 and a nose 118 so that the cup 114 appears to represent an eye under one of the eyebrows. Thus a modernistic display is provided. Rear and bottom sides 119 and 119A of the carton may be decorated with hair.

In FIG. 12 another design is seen which includes a metal inner vessel 121 having notches 122 so to serve as an ashtray and cigarette rest. A metal sleeve 123 mounted on a bottom of the vessel serves as a cigarette or cigar light snuffer. A picture card 15 is wrapped around the outer side of the vessel 121 and is visible through a transparent topless outer vessel 124 fitted therearound. Notches 122 on the upper edge of vessel 124 can also serve as a cigarette rest. When the vessels and card are interfitted together, a cap 125 fits snugly around the upper end of vessel 124 to hold the components together. The cap can serve as a cigarette rest by including notches 122A.

In FIGS. 13, 14 and 15, another design of device 130 includes transparent container 131 with card 15 inside. The container fits in an ashtray vessel 132 having a cigarette rest notches 122. In this design, a flap 133 affixed on an outer side of the vessel has a notch 134 that aligns with notch 122 so to support a short cigarette 25A with the ashes 135 thereof disposed over the center of the ashtray vessel. The flaps 133 is accordingly, naturally bent away from the ashtray vessel side well but is bendable to rest adjacent thereto when the container 131 is inside the ashtray container. A transparent top cover 136 fits over the container 131 so to close a cigarette dispensing openings. When the hole 137 on the top cover disaligns from the container when the device is tipped upside down. Cigarette lighter 12 extends up through the cover 136 for use therewith.

Figures 16, 17, 18, 19, 20, 21, 22:
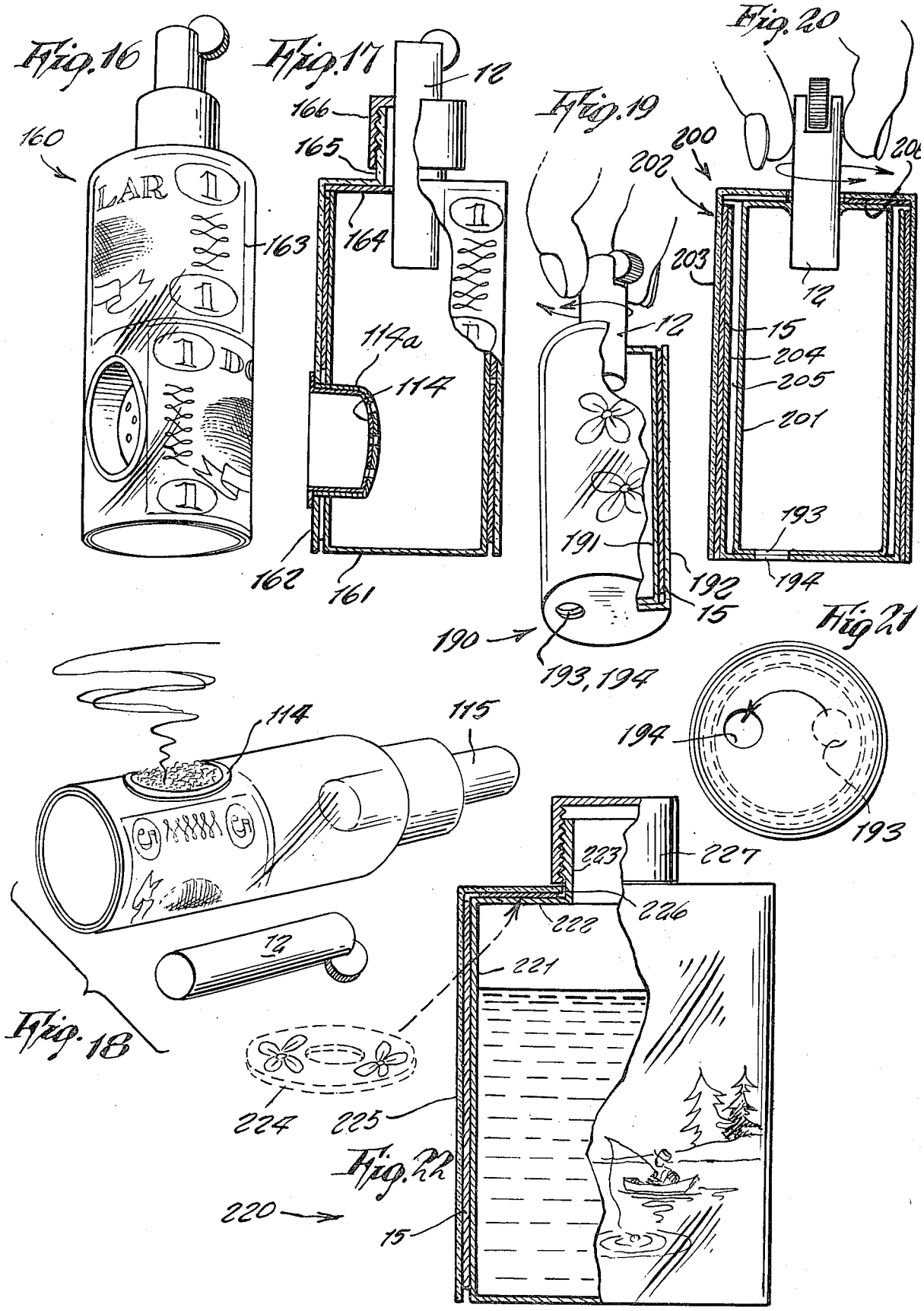
FIG. 16 is a perspective view of another design which can be used as a pipe.
FIG. 17 is a cross sectional view thereof.
FIG. 18 shows the device in use for smoking tabacco.
FIG. 19 shows another design that includes a rotatable barrell
FIG. 20 is a cross section of another rotatable construction, wherein the lighter is secured to the inner barrell or tube.
FIG. 21 is a bottom view thereof.
FIG. 22 is a side view partly in cross section of still another design.

In FIGS. 16, 17 and 18 another design similar to the container 111 shown of FIG. 11. It includes vessel 161, transparent cover 162 with paper money 163 displayed therebetween. It also includes decorative disc 164, and a neck 165 of the cover screw-engages a cap 166, that frictionally holds either a cigarette lighter 12 or a mouthpiece tube 115 interchangeably. Perforated cup 114 is surrounded with a perforated foil 114A and fitted through a recess in 162 and 161. Cap 166 can be deleted if desired.

In FIG. 19 still another design is shown to include inner vessel 191 an outer transparent vessel 192 and a card 15 between the inner and outer vessels. The inner vessel is rigidly secured to a cigarette lighter 12 extending upwardly.

Eccentrically located holes 193 and 194 in vessels 191 and 192 are selectively disaligned or aligned in order to dispense cigarettes or other articles out of the interior of the container.

In FIGS. 20 and 21, another design of device 200 includes cigarette lighter 12 rigidly affixed through a center of a topwall of bottle 201. The bottle is covered by a hood 202 comprised of a transparent cover 203 fitted with a card 15 on its inner side and the card is fitted around a vessel 204 so that the hood freely rotates as a unit around the bottle. A decorating disc 206 is placed beneath a topwall of the cover. A central hole through the disc and the topwall of the cover serve to clear the cigarette lighter extending upwardly therethrough.

An eccentric hole 193 in the bottle aligns with eccentric hole 194 in the vessel so to dispense the bottle content. To dispense just rotate the lighter 12 while holding the hood.

In FIG. 22 a design is seen to hold water (or alternatively sand and water) for decorative purposes. An inner transparent vessel 221 having an intergral neck 223 with threaded outer surface has a cap 227 threaded thereon. An outer transparent shell 225 with a picture card 15 thereunder, is affixed to vessel 221 by means of tranverse collar 226 which is engaged by cap 227. An apertured disc 224 is mounted between the collar 226 and top wall 222 for decorative purposes. A cigarette lighter may be mounted in neck 223 as described in regard to FIG. 2.

Figures 23, 24, 25, 26, 27:
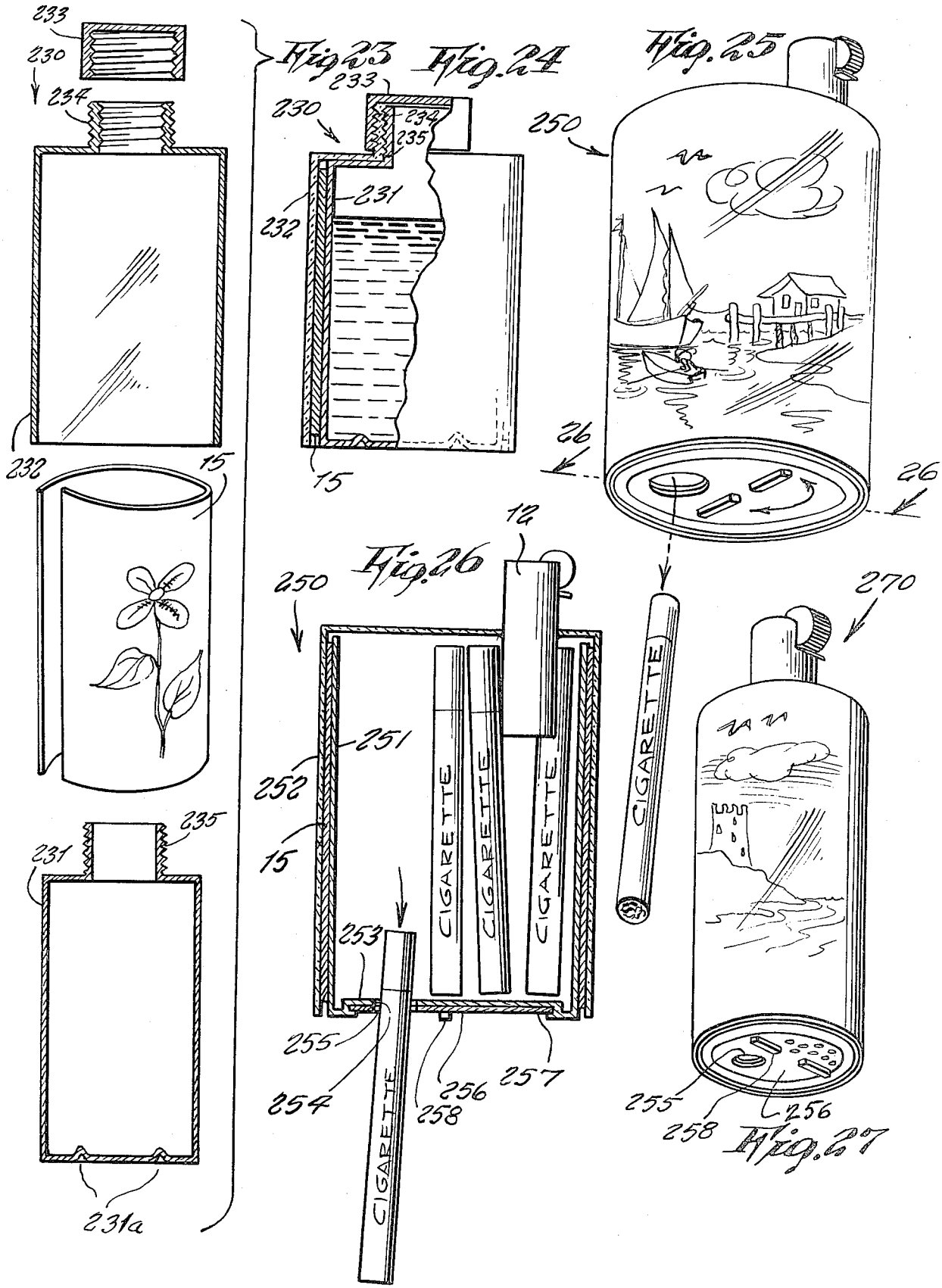
FIG. 23 shows components in exploded position of still another modified design.
FIG. 24 is an assembled view thereof.
FIG. 25 shows another design with rotatable bottom so to dispense cigarettes therethrough.
FIG. 26 is a cross sectional view thereof on line 26—26 of FIG. 25.
FIG. 27 is a perspective view of a simplified form of FIG. 25.

In FIGS. 23 and 24, still another design 230 is shown comprised of inner bottle or vessel 231, a transparent outer cover 232, a decorative card 15 between the bottle and the cover and a cap 233 screwed around a neck 234 of the cover. The dimples 231A are provided for gripping vessel 231 for removal.

In FIGS. 25 and 26, still another design 250 includes vessel 251, a transparent cover 252 over the vessel, a cigeratte lighter 12 secured to the cover, a bottom wall 253 of the vessel having an eccentric opening 254 for selective alignment with a circular opening 255 of an underside of the bottom wall 253, cigarettes can be dispensed from the container. Cleats 258 on the underside of the disc 256 allows grasping of the disc so as to rotate it.

In FIG. 27, a device 270 is of similiar design as device 250 except that it comprises a narrower model, that has a single decorated tubular shell enclosure, having the disc 256 rotatably mounted in the bottom.

Figures 28, 29, 30:
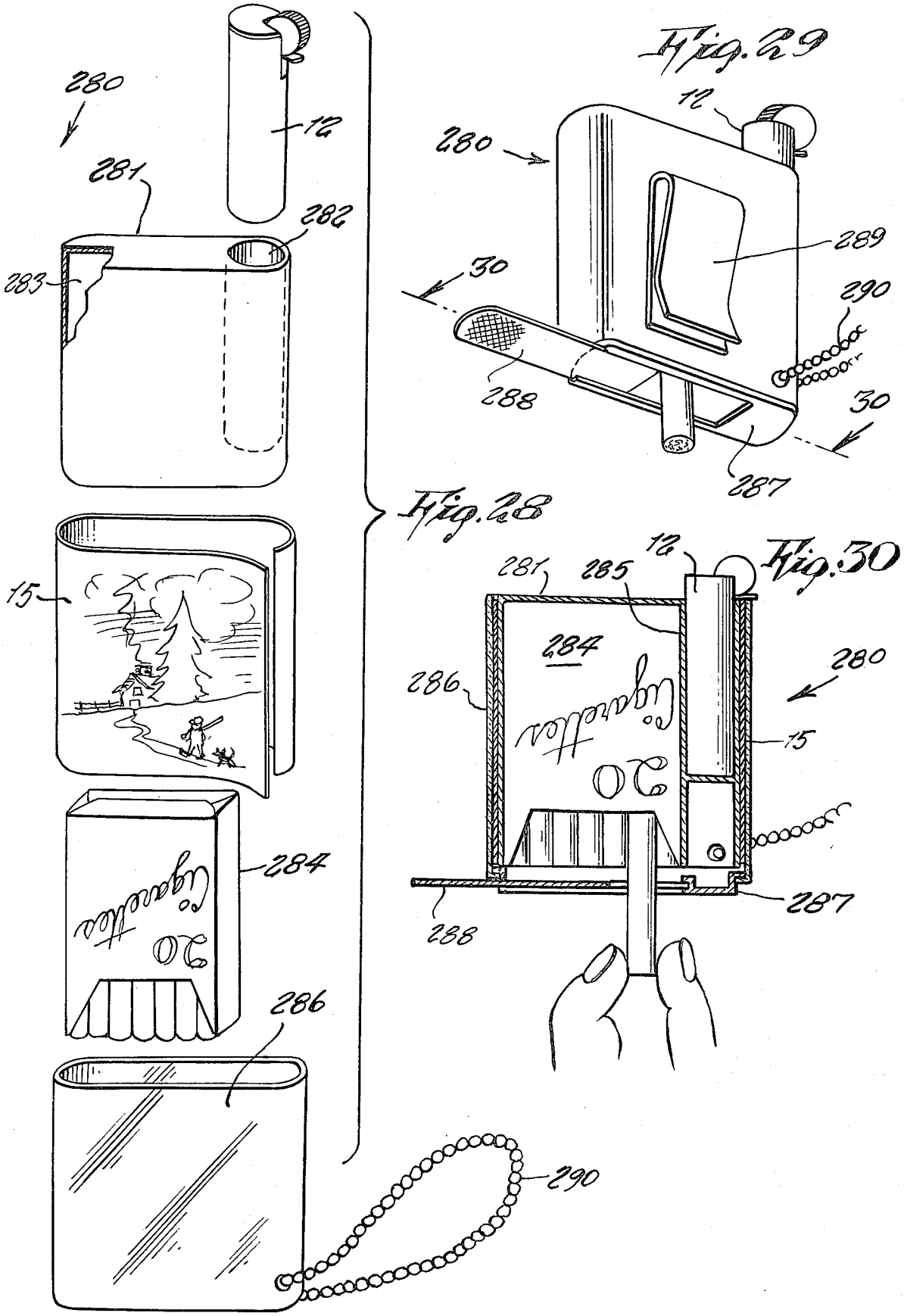
FIG. 28 is an exploded perspective view of still another design in which the container is flat sided to fit comfortably in a hip or other pocket or purse.
FIG. 29 is a perspective view thereof shown assembled and illustrating a clip on a rear side of the case for clipping on a belt; the underside of the case showing a sliding door device in a bottom lid.
FIG. 30 is a cross sectional view on line 30—30 of FIG. 29.

In FIGS. 28, 29 and 30 a design 280 is of flat sided shape so as to fit in a purse or pocket such as hip pocket without bulging. It includes a flat container 281 having a pocket 282 for the cigarette lighter 12, and a pocket 283 for a packet of cigarettes 284. The pockets are separated by a partition 285.

The container 281 has a decorative card 15 wrapped around it, and a transparent cover 286 is then fitted around the outer side of the card. The cover is tubular and a lid 287 may be snapped into its lower end. A door 288 is (seen in FIGS. 29 and 30) is slidable in grooves and provided on the lid to uncover an opening through the lid and thus allow dispensing of cigarettes 284 from the packet and outwardly of an underside of the device 280, so that the same can be accomplished by a single hand. It should be understood that 286 can be alternately dimensioned to fit inside of 283 with card 15 therebetween, in which case 283 will be transparent.

A clip 289 affixed on a rear side of the cover permits support of device 280 from a belt. Said clip 289 may be removably mounted on the cover so that the device may be carried in a pocket or mounted on a belt.

A chain 290 is attached to the device 280 allows support of the device from around a persons neck. Keys may be suspended on the chain is so wished.

Keys and money may be stored inside the device of FIG. 28 if so desired to function also as a wallet.

It is thus apparent that the above described articles have a multitude of uses, while presenting an attractive appearance which obviously can be varied by changing the picture card, or other appropriate decorative inserts.

It is again noted that all the containers in all of the Figures disputed herein have transparent outer walls with a decorative insert mounted on the inner surface of the outer wall to provide an external decorative effect.

While various changes may be made in the detail construction, it is understood that such changes will be within the spriit and scope of the present Invention as is defined by the appended claims.

The following is claimed:

1. A decorated container comprising a transparent encompassing outer cover having a decorative insert disposed and secured within said cover and encompassed thereby including an aperature through one end of said cover having securing means for receiving and securing therethrough objects of predetermined function wherein said cover includes a neck extending from a transverse shoulder said aperture formed through said neck including a reraining within said container in the form of a vessel retaining said insert inclose abuttment with said cover, said cover having a bottom edge extending beyond nsaid insert, said vessel having a all aligned with the bottom edge of said cover, wherein a second vessel for storing articles is fitted rotatably inside first said vessel, each vessel having an opening through a bottom wall thereof, said second vessel including a top wall affixed to said cigarette lighter for manual rotation of said second vessel in order to align said openings together for dispensing articles within said second vessel.

2. The combination of claim 1 including a bottom wall in said container having a rotatable disc mounted therein, said bottom wall and said disc each having eccentrically positioned holes whereby the hole in said disc being movable to an aligned position allowing dispensing of an article from within said container.

3. The combination of claim 1 wherein the container is mounted on a display case having various facial features on the outer surfaces of said display case and said lighter is interchangeable with a mouthpiece adapted be mounted is said aperture.

4. The combination of claim 3, wherein the container includes a perforated cup mounted in a hole in said container wherein said cup is so located relative to the features that said cup simulates an eye under an eyebrow.

* * * * *